United States Patent [19]

Smith

[11] 4,195,751

[45] Apr. 1, 1980

[54] CUP SELECTION APPARATUS FOR BEVERAGE VENDING MACHINE TO THE IN-CUP TYPE

[75] Inventor: David B. Smith, Rugby, England

[73] Assignee: Brooke Bond Vending Systems Limited, Warwickshire, England

[21] Appl. No.: 891,512

[22] Filed: Mar. 30, 1978

[30] Foreign Application Priority Data

Jun. 30, 1977 [GB] United Kingdom ..... 27385/77

[51] Int. Cl.[2] ..... A47F 1/08; G07F 11/32

[52] U.S. Cl. ..... 221/17; 221/96; 221/129; 221/130

[58] Field of Search ..... 221/17, 96, 123, 126, 221/129, 130, 131, 133, 222, 223

[56] References Cited

U.S. PATENT DOCUMENTS

| | | | |
|---|---|---|---|
| 2,830,627 | 4/1958 | Polsen et al. | 221/222 X |
| 3,156,340 | 11/1964 | Arkes | 221/129 X |
| 3,340,979 | 9/1967 | Howard, Jr. | 221/129 X |
| 3,831,806 | 8/1974 | Lindsey | 221/129 X |

FOREIGN PATENT DOCUMENTS

| | | | |
|---|---|---|---|
| 1090016 | 1/1967 | United Kingdom | 221/223 |

*Primary Examiner*—David A. Scherbel
*Attorney, Agent, or Firm*—Gifford, Chandler, VanOphem, Sheridan & Sprinkle

[57] ABSTRACT

Cup selection apparatus in a vending machine of the "in-cup" type consisting of a plurality of cup-storage tubes, in each of which, in use, a stack of cups nested one in another is placed, a selectively-operable cup-dispensing device associated with each cup-storage tube to separate the bottom cup from a stack of nested cups in that cup-storage tube, at least one cup-delivery tube connected to the outlet end of each of at least two of the cup-storage tubes, a cup-guiding chute leading from the or each cup-delivery tube to a cup-filling station at which water is to be added to the dry ingredients in a cup, the cup-storage tubes, the cup-delivery tube or tubes and the cup-guiding chute being positioned so that a cup after release by the cup-dispensing device from a stack of nested cups in a cup-storage tube will travel by gravity to the cup-filling station.

22 Claims, 6 Drawing Figures

CUP SELECTION APPARATUS FOR BEVERAGE VENDING MACHINE TO THE IN-CUP TYPE

FIELD OF THE INVENTION

The invention relates to a cup selection apparatus for use with or in a beverage vending machine of the "in-cup" type.

In the "in-cup" method of vending beverages, nestable cups are pre-charged with dry ingredients and are nested one in another in stacks to retain the ingredients in the bottom of each cup (except the top cup of a stack) and to maintain the ingredients in each cup free from contamination. In a vending machine of the "in-cup" type a cup is removed from the bottom of a stack selected from a plurality of stacks according to the beverage required to be dispensed and is delivered to a station where water, usually hot water, and sometimes also sugar, where sugar is not one of the dry ingredients in the cup, is added to the ingredients in the cup.

DESCRIPTION OF THE PRIOR ART

A known "in-cup" type of vending machine comprises a rotatable magazine of cup-storage tubes in which the tubes are arranged with their longitudinal axes parallel to and spaced circumferentially around the axis of rotation of the magazine. Each tube contains a stack of nested cups, the cups in one cup-storage tube each containing one kind of ingredients and the cups in another cup-storage tube each containing another kind of ingredients. In operation of the vending machine, the magazine is rotated to bring a particular cup-storage tube, according to the beverage selected, into a position where a cup is removed from the bottom of the stack of cups in that cup-storage tube and is delivered to a station where water, and sometimes also sugar, is added to the dry ingredients in the cup. Such a machine has the disadvantage that the overall diameter of the magazine about the axis of rotation thereof is determined by the size of the machine and so limits the number of cup-storage tubes which can be accommodated in the magazine and therefore the number of different kinds of beverage from which a selection can be made. An object of the invention is to provide a cup selection apparatus for use with or in a beverage vending machine of the "in-cup" type which does not include a rotatable magazine of cup-storage tubes.

BRIEF SUMMARY OF INVENTION

According to the invention, the cup selection apparatus comprises a plurality of cup-storage tubes, in each of which, in use, a stack of cups nested one in another is placed, selectively-operable cup-dispensing means associated with each cup-storage tube to separate the bottom cup from a stack of nested cups in that cup-storage tube, at least one cup-delivery tube connected to the outlet end of each of at least two of the cup-storage tubes, cup-guiding means leading from the or each cup-delivery tube to a cup-filling station at which water is to be added to the dry ingredients in a cup, the cup-storage tubes, the cup-delivery tube or tubes and the cup-guiding means being so arranged that a cup after release by the cup-dispensing means from a stack of nested cups in a cup-storage tube will travel by gravity to the cup-filling station, and selector means operable to actuate the cup-dispensing means associated with a selected cup-storage tube, whereby a cup from the selected cup-storage tube will travel to the cup-filling station.

Conveniently, the or each cup-delivery tube is arranged with its longitudinal axis vertical, or substantially vertical, and each cup-storage tube communicating therewith is arranged with its longitudinal axis inclined at an acute angle to the longitudinal axis of the cup-delivery tube, whereby a cup separated from a stack of nested cups in a cup-storage tube will pass down the remainder of the cup-storage tube and will be tipped to an upright position by the cup-delivery tube at the intersection of the cup-storage tube with the cup-delivery tube.

Conveniently there may be two or more vertical, or substantially vertical, cup-delivery tubes positioned side-by-side and each communicating with two or more inclined cup-storage tubes positioned one above the other and extending from at least one side of the longitudinal axis of the associated cup-delivery tube, the intersections of the cup-storage tubes being spaced apart one above another longitudinally of the cup-delivery tube with which they communicate.

The inclined cup-storage tubes communicating with a cup-delivery tube may extend outwardly from one side only of the longitudinal axis of the cup-delivery tube. In that case two cup-delivery tubes may be arranged side-by-side with their associated cup-storage tubes extending outwardly from the side of the longitudinal axis of the associated cup-delivery tube remote from the other cup-delivery tube. Alternatively cup-storage tubes may extend outwardly from a common cup-delivery tube on diametrically-opposite sides of the longitudinal axis thereof.

Where there are two or more vertical, or substantially vertical, cup-delivery tubes, they may communicate, in use, at their lower ends with a common chute being the aforesaid cup-guiding means. The chute may taper from an upper mouth shaped to receive cups from either or any one of the cup-delivery tubes to a circular or part-circular outlet through which cups will pass singly to the cup-filling station.

The cup-storage tubes and the cup-delivery tubes may be mounted, as a unit, for swinging about a vertical or horizontal axis or for sliding transversely or longitudinally of the longitudinal axis of the cup-delivery tube or axes of the cup-delivery tubes, where there are several cup-delivery tubes, relatively to the cup-filling station. One or other of such constructions may be desirable to enable the cup-storage tubes to be loaded with cups or to be removed from the remainder of the unit for that purpose.

The cup-storage tubes associated with a cup-delivery tube, or with a plurality of cup-delivery tubes, may be mounted as a unit for swinging about a vertical axis into and out of communication with the cup-delivery tube or respective cup-delivery tubes, thereby to provide access to the lower ends of the cup-storage tubes to enable stacks of nested cups to be inserted into the latter from the lower ends thereof, the cup-storage tubes then being returned, as a unit, to enable their lower ends to communicate again with the associated cup-delivery tube or tubes.

The cup-dispensing means may be of a kind comprising a ring coaxial with the cup-storage tube and including jaw members which are movable into and out of positions in which they will engage the rim of a cup around its periphery and are operable to separate the bottom cup axially from the next higher cup in the stack and then to release the separated cup to permit it to travel downwardly to the associated cup-delivery tube. The jaw members of the rings may be movable by electrically-operable means, the latter being selectively-operable according to which beverage has been selected and therefore from which stack a cup is to be separated.

BRIEF DESCRIPTION OF DRAWINGS

By way of example, two embodiments of cup selection apparatus in accordance with the invention are now described with reference to the accompanying drawings, in which.

DETAILED DESCRIPTION OF INVENTION

Figure 1:
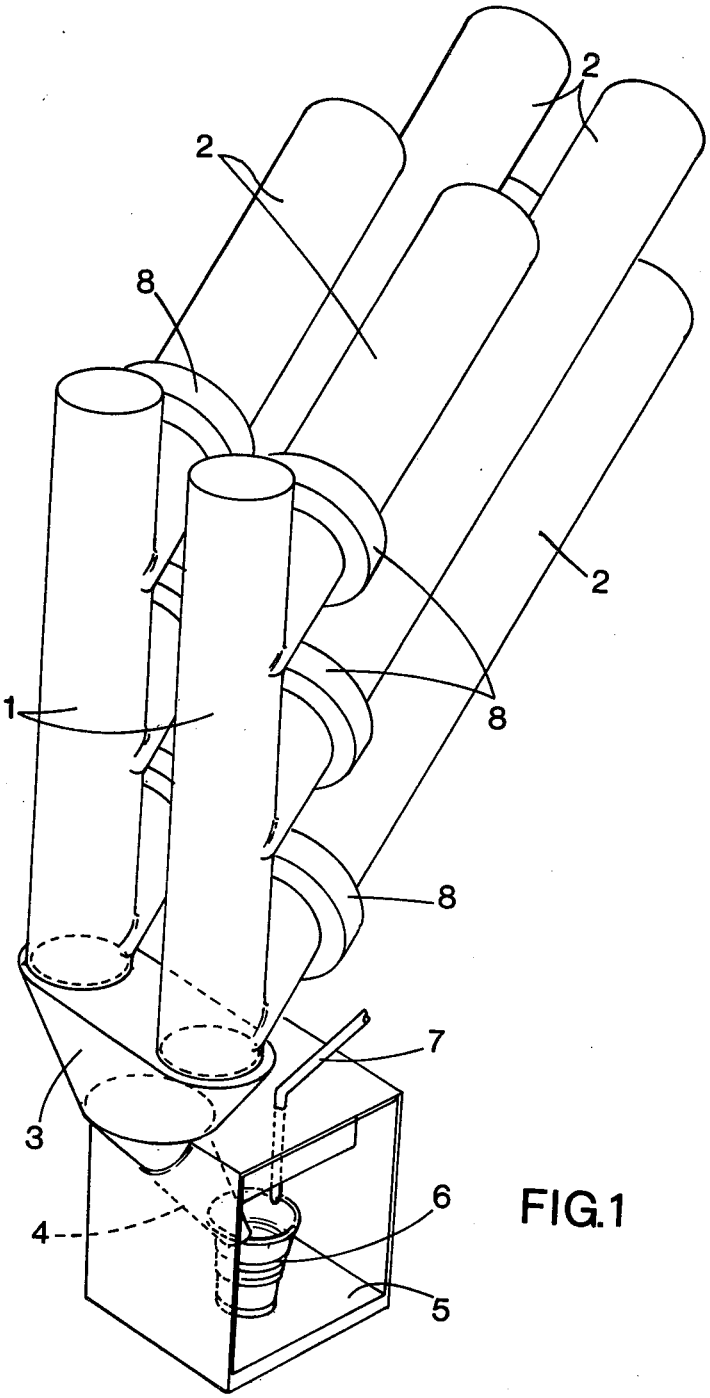
FIG. 1 is a perspective diagrammatic sketch of the first embodiment.

Referring to FIG. 1, the apparatus of the first embodiment comprises a pair of cup-delivery tubes 1 arranged vertically, or substantially vertically, and from which a plurality of (e.g., three) cup-storage tubes 2 extend outwardly fron one side of the longitudinal axis of each cup-delivery tube 1. The longitudinal axis of each cup-storage tube 2 is inclined at an acute angle to the longitudinal axis of the associated cup-delivery tube 1. The cup-storage tubes 2 associated with each cup-delivery tube 1 are positioned one above the other, the intersections of the lower ends of the cup-storage tubes 2 with the associated cup-delivery tube 1 being spaced apart in the longitudinal direction of the cup-delivery tube 1. Although in the arrangement shown in the drawing there are two cup-delivery tubes 1 positioned side-by-side and each cup-delivery tube 1 has three cup-storage tubes 2 associated therewith, there may be any number (including one) of cup-delivery tubes 1 positioned side-by-side and each cup-delivery tube 1 may have any number of associated cup-storage tubes 2 positioned one above the other. The cup-delivery tubes 1 communicate at their lower ends with a common cup chute 3 which is shaped to guide a cup falling from the lower end of either or any one of the cup-delivery tubes 1 to a circular or part-circular outlet 4 at the lower end of the cup chute from which the cup will be guided to a cup station 5, where the cup 6 will be deposited in an upright manner, as shown, and filled with hot water through a supply pipe 7. Each cup-storage tube 2 includes nearer its lower end a cup-dispensing ring 8, which may be of a known kind and is operated selectively according to the beverage selected by electrical, pneumatic or fluid-operated means or a combination of any of such means.

In use, stacks of nested cups which have been precharged with dry ingredients are placed in the cup-storage tubes 2. Each cup in one cup-storage tube 2 contains one type of ingredients and each cup in another storage tube contains a different type of ingredients, whereby in the example illustrated in FIG. 1, stacks of cups containing six different kinds of ingredients may be accommdated. When a particular beverage is to be selected, the user presses an appropriate button of the machine and this actuates the corresponding cup-dispensing ring 8 which extracts a cup from the bottom of the stack of cups in the associated cup-storage tube 2 and releases the cup so that it will fall from the cup-storage tube 2 into the associated cup-discharge tube 1 and then into the cup chute 3 to the cup-filling station 5, where hot or cold water will be introduced into the cup through the pipe 7. The customer can then take the cup which will contain the appropriate beverage selected.

The apparatus provided by this invention enables a selection of beverages to be dispensed by the vending machine, the nested cups being stored in the battery of cup-storage tubes 2 illustrated which will be accommodated in a comparatively compact manner compared with known types of "in-cup" vending machines. Furthermore the use of a rotatable magazine of cup-storage tubes, as proposed hitherto, is avoided.

The arrangement of cup-delivery tubes 1 and cup-storage tubes 2 as illustrated in FIG. 1 may be duplicated by mounting a similar arrangement of cup-delivery tubes 1 with its associated cup-storage tubes 2 back-to-back, the cup-storage tubes 2 associated with the two sets of cup-delivery tubes 1 extending outwardly from each of the associated cup-delivery tubes 1 from the side thereof remote from the other cup-delivery tubes. Thus in the duplicated arrangement there will be, for example, four cup-delivery tubes 1 and twelve cup-storage tubes 2. The cup-delivery tubes 1 may be arranged to discharge into a common cup-chute 3.

Figure 2:
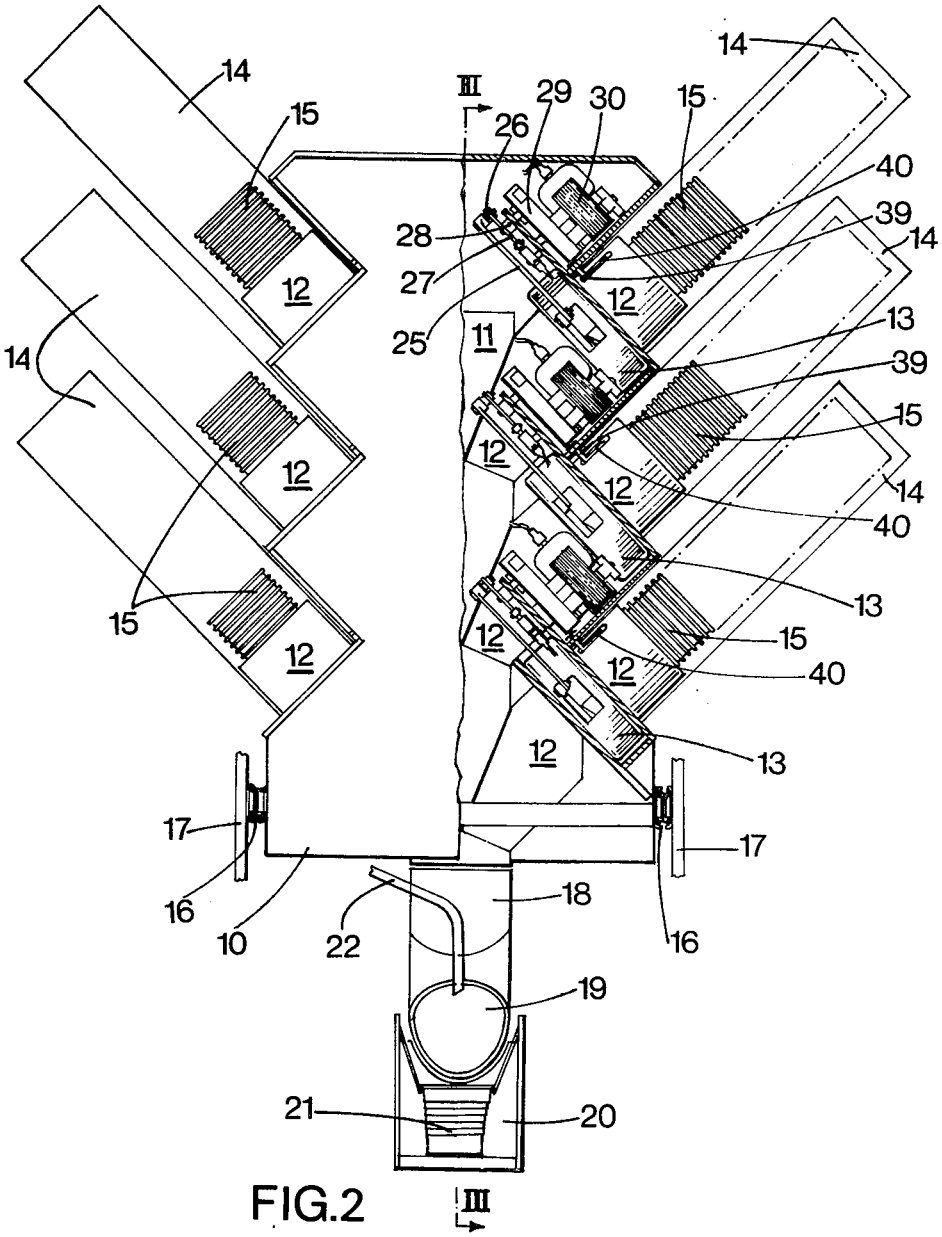
FIG. 2 is a front elevation and partial vertical section of the second embodiment.
Figure 3:
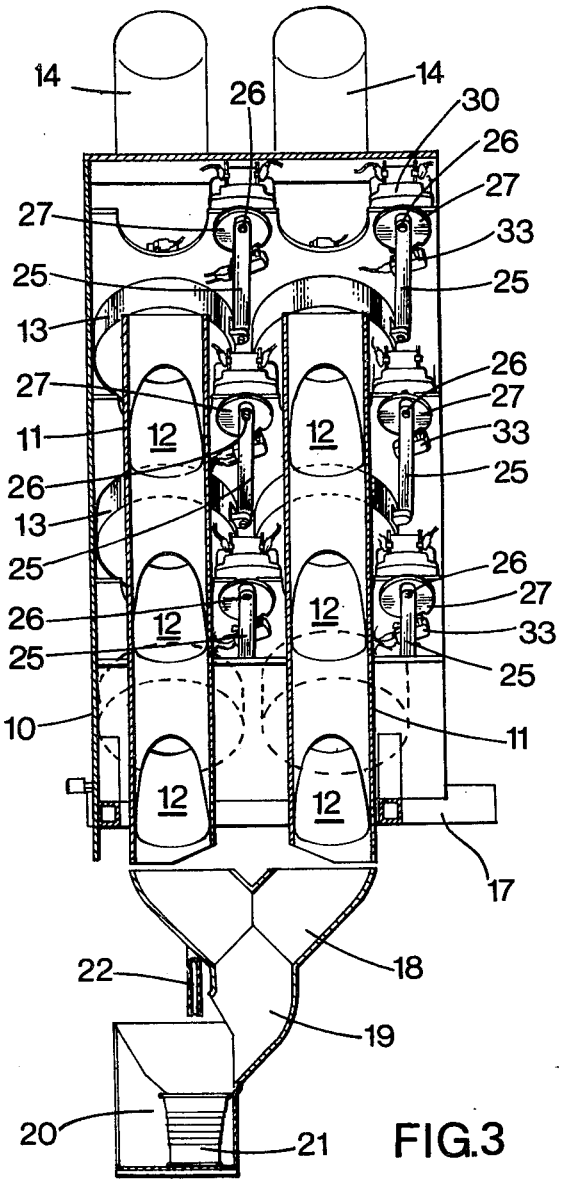
FIG. 3 is a section on the line III—III in FIG. 2.

Alternatively, further cup-storage tubes 2 could extend from each of the cup-delivery tubes 1 on diametrically-opposite sides thereof from the illustrated positions in FIG. 1 so that each cup-delivery tube 1 would, for example, communicate with and receive cups from, say, six cup-storage tubes 2, that is, there would be two cup-delivery tubes 1 and twelve cup-storage tubes. Such an arrangement is shown in FIGS. 2 and 3 to be described hereinafter.

The cup-storage tubes 2 and the cup-delivery tubes 1 may be arranged to be swung as a unit about a vertical axis. Such a construction may be desirable to enable the cup-storage tubes 2 to be loaded with cups or to be removed from the remainder of the apparatus for that purpose or for servicing. Alternatively the unit of cup-storage tubes 2 and cup-delivery tubes 1 may be pivotable about a horizontal axis or they may be slidable longitudinally or transversely of the axes of the cup-delivery tubes 1 to enable the cups to be loaded into the cup-storage tubes or the cup-storage tubes 2 to be removed for that purpose or for servicing. In the second embodiment shown in FIGS. 2 and 3, the cup-delivery tubes and the cup-storage tubes are slidable as a unit horizontally, as hereinafter described.

In yet another construction, the cup-storage tubes 2 may be arranged to be swung as a unit or individually about a vertical axis, to enable the cup-storage tubes 2 to be separated from lower end portions of the cup-storage tubes 2 or from the associated cup-delivery tubes 1 to enable stacks of cups to be loaded from the lower ends of the cup-storage tubes 2, as this may, in some constructions of vending machine be more convenient than loading stacks of cups from the upper ends of the cup-storage tubes 2. The cup-storage tubes 2 would then be swung back to be re-engaged with their lower end portions or with the cup-delivery tubes 1.

The cup-dispensing rings 8 may be of known kind. For example, they may be of the kind including a ring of scroll-like jaws which are arranged to be electrically-operated to grip around the periphery of the rim of the bottom cup of a stack and then to separate that cup axially from the remainder of the stack of cups and then to release the cup so that it will fall by gravity into the cup-delivery tube 1 associated with the cup-storage tube 2 containing the stack of cups from which the cup has been separated. Cup-dispensing rings of this kind are shown in FIGS. 2 and 3 and are described hereinafter with particular reference to FIG. 4.

Referring now to FIGS. 2 and 3, the second embodiment of the apparatus comprises a housing 10 containing, in a unit, a pair of vertical cup-delivery tubes 11 arranged one behind the other, as shown in FIG. 3, and each having upwardly-facing tubular branches 12 extending from each side of the vertical axis of the relevant tube 11. The longitudinal axis of each branch 12 extends at an acute angle, in this example 45°, to the longitudinal axis of the tube 11. There are three branches 12 positioned one above the other at each side of each tube 11, that is twelve branches 12 altogether. Each branch 12 carries at its upper end a cup-dispensing ring 13. Each cup-dispensing ring supports a cup-storage tube 14 each shown containing a stack of nested cups 15. This whole unit within the housing 10 is supported on a pair of horizontal rails 16 from stationary supporting plates 17 in an outer cabinet (not shown), whereby the housing 10 and the unit can be withdrawn from the cabinet for recharging the cup-storage tubes 14 with cups 15 or for servicing.

The lower end of each cup-delivery tube 11, when the housing 10 is in its normal position within the outer cabinet, is positioned above a fixed twin-mouthed chute 18 having a common outlet 19 leading to a cup-filling station 20, where hot or cold water, as required, is introduced into a cup in position 21 at the station 20 through a filling pipe 22.

As for the first embodiment, on actuating one of the cup-dispensing rings 13, as hereinafter described, a cup is extracted by that ring from the bottom of the stack of cups 15 in the corresponding cup-storage tube 14. On release of the cup by the ring 13 it will fall down the tubular branch 12 into the cup-delivery tube 11 with which that branch 12 communicates. The cup will be tipped upright on entering the cup-delivery tube 11 and will fall through the latter to the chute 18 and the outlet 19 to the cup-filling station 20 and will assume the position 21. The cup at the position 21 will then be filled with water through the pipe 22.

The cup-dispensing rings 13 are electrically operated and are now described with reference particularly to FIG. 4. Each cup-dispensing ring 13 is of known construction and has an annular housing defining a gallery around an upper portion of the relevant branch 12 and communicating with the interior thereof. The gallery contains a plurality of circumferentially-spaced cam-like pinions 23 (the aforesaid jaw members) operated by part annular rack portions on a scroll 24. When the scroll 24 is turned in one circumferential direction, it will cause the pinions 23 to grip the rim of the lowermost cup in the stack 15 in the relevant cup-storage tube 14 and to pull the cup axially from the stack. On turning the scroll 24 in the reverse direction, the pinions 23 will release the cup, thereby enabling it to fall through the branch 12, as hereinbefore described. The scroll 24 is reciprocated circumferentially by a crank arm 25 pivotally connected to a pin 26 extending from a disc 27 mounted on a rotatable shaft 28. The shaft 28 is driven by a gear drive (not shown) within a gear box 29 of which an input gear is arranged to be turned by an electric motor 30 having an output shaft 31 (shown in FIG. 4). The motor 30 has a winding 32 which is connected at one end to ground (a part of the housing 10) and at the other end to a common contact C of a switch 33, there being a switch 33 and a motor 30 for each cup-dispensing ring 13. Each switch 33 also has contacts N.C. and N.O., the N.C. contact being normally-closed by contacting the common contact C and the N.O. contact being normally-open with respect to the common contact C. The positions of the contacts N.C. and N.O. are changed by an actuating arm 34, which carries a roller follower 35 engaging the periphery of the disc 27. The latter has at one position in its circumference a dwell recess 36. In the illustrated position, the follower 35 is in the recess 36 and the contact N.C. and N.O. are respectively closed and open with respect to the common contact C. When the disc 27 has been turned by the electric motor 30, as will hereinafter be explained, to a position in which the follower 35 engages the periphery of the disc 27, the positions of the contacts N.C. and N.O. are interchanged with respect to the common contact C. The N.O. contact of switch 33 is connected by a conductor 37 to a sustaining electrical supply. The N.C. contact of switch 33 is connected to an N.O. contact of a switch 38 similar to switch 33 and of which there is one associated with each cup-storage tube 14. In the tubular branch 12 supporting each cup-storage tube 14 there is a switch arm 39 pivotally mounted on common contact C and which extends through a slot 40 in the outer portion of the tubular branch 12 and is arranged to bear against the lowermost cup in a stack of cups 15 in the cup-storage tube. Provided there is a cup left in the cup-storage tube 14, the relevant switch arm 39 will be in the position illustrated in FIG. 4 and will bridge contacts C and N.O. of the relevant switch 38. The common contact C of the switch 38 is connected by conductor 50 to a Product Selection Button Switch, as hereinafter explained. If there is no cup left in the cup-storage tube 14, the arm 39 will pivot downwardly under gravity about the pivot at contact C until the arm bridges the contacts C and N.C. of the switch 38.

Figure 4:
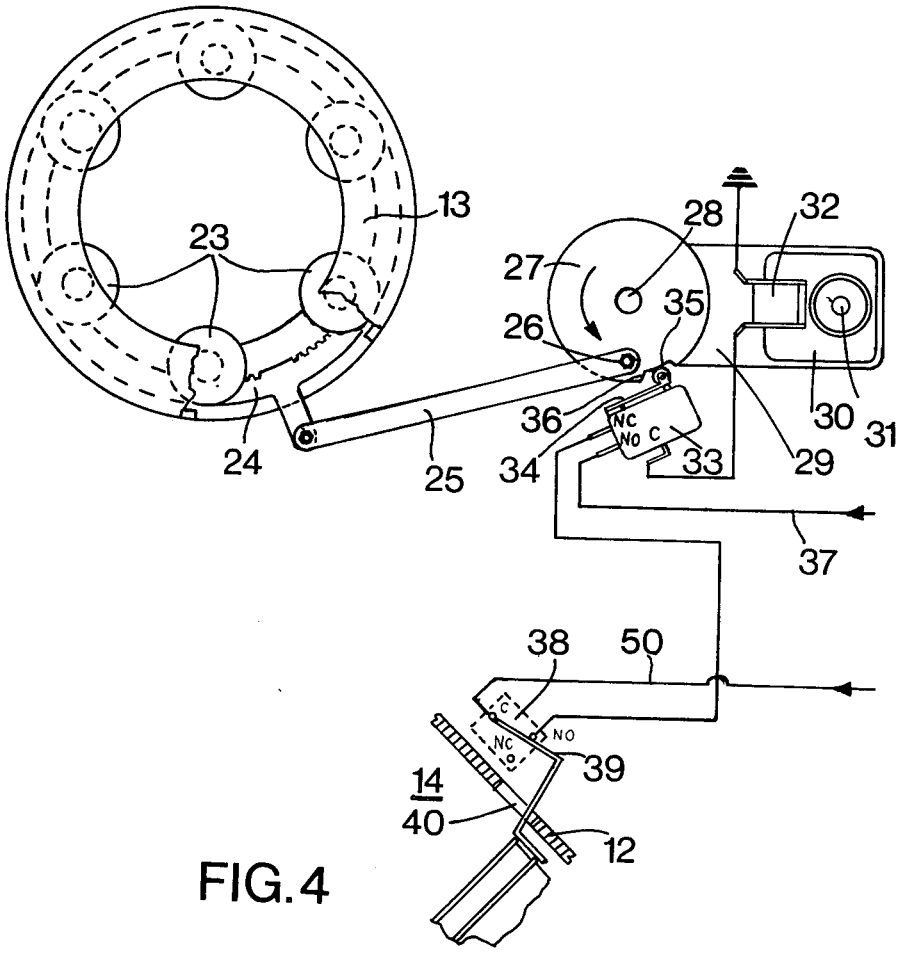
FIG. 4 is a circuit diagram and sketch showing a cup-dispensing mechanism and cup-detection mechanism in a cup-storage tube of either embodiment.

The operation of the cup-dispensing ring 13 and the circuit shown in FIG. 4 is as follows. Assuming that a customer depresses the button switch appropriate for the cup-storage tube illustrated in FIG. 4 and that there are cups 15 therein holding the arm 39 in the position illustrated, there is a circuit from an energising electrical supply via the depressed button switch, conductor 50, the contacts N.O. and C bridged by the arm 39, the N.C. and C contacts of the associated switch 33 because the follower 35 thereof is in the dwell recess 36 of the disc 27, and the motor coil 32 to ground. The motor 30 will then operate and drive the disc 27 causing the follower 35 to ride out of the dwell recess 36 and thereby effect the opening of N.C. and the closing of N.O. contacts with respect to contact C of switch 33. This will connect the motor coil to the sustaining electrical supply and then the button switch will be opened by a time delay switch (not shown). The motor 30 will continue to turn the disc 27 through one complete revolution until the follower 35 again enters the dwell recess 36 and the N.C. and N.O. contacts revert to their normal positions with respect to contact C and the motor will stop. In turning through one revolution, the disc 27 will reciprocate the crank arm 25 by the pin 26 and the scroll 24 will cause the pinions 23 to separate the bottom cup from the stack of cups 15 and release the cup so that it will fall through the tubular branch 12 and the cup-delivery tube 11 to the cup-filling station 20. The disc 27 by turning through one revolution only always stops in the illustrated position from which it will be turned when the appropriate selection button switch is operated, provided the corresponding cup-storage tube 14 still contains cups.

Figure 6:
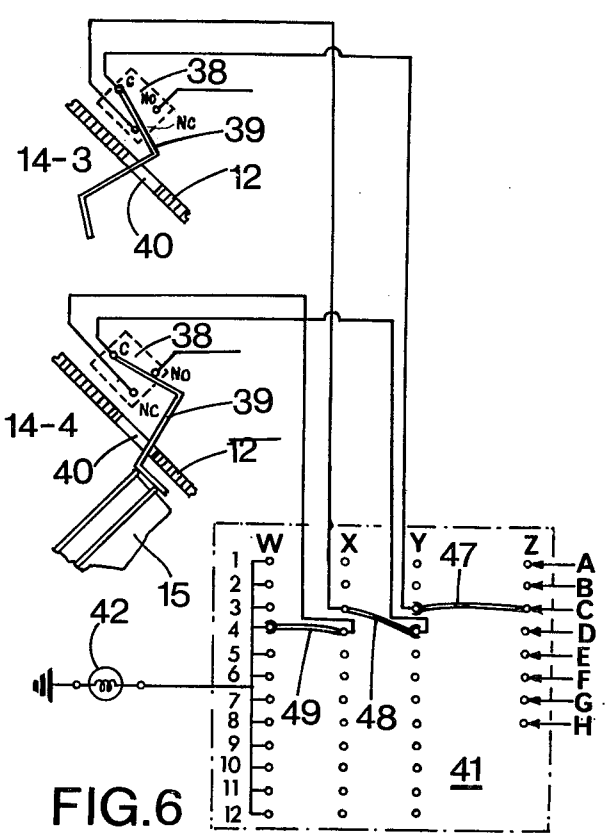
FIG. 6 is a circuit diagram and sketch, similar to FIG. 5, showing a second mode of operation of the detecting and indicating means shown in FIG. 5.
Figure 5:
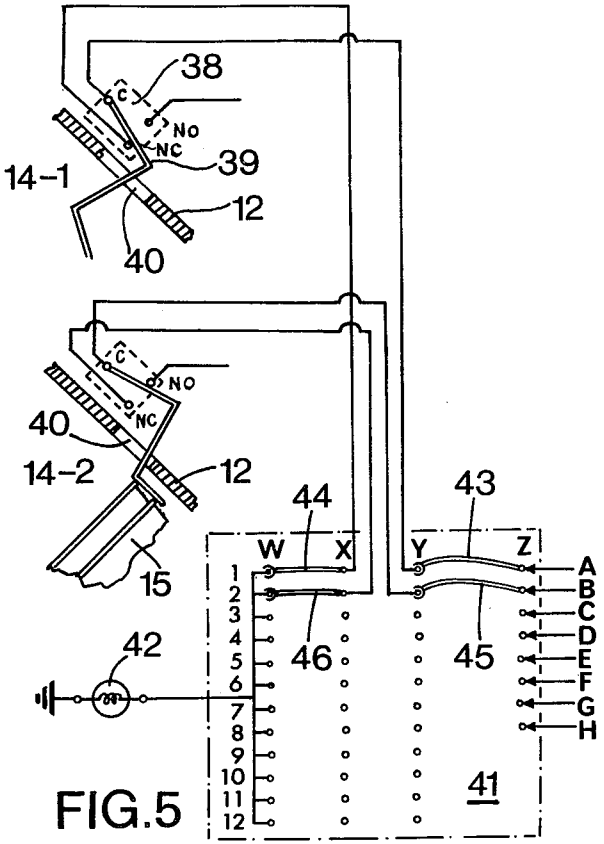
FIG. 5 is a circuit diagram and sketch showing a first mode of operation of means for detecting and indicating the absence of cups in a cup-storage tube in either embodiment.

The control circuit for selecting a cup from a particular cup-storage tube and the means for detecting and indicating the absence of cups in the selected cup-storage tube is now described with reference to two alternative modes of operation and relevant connections as shown in FIGS. 5 and 6.

Referring first to FIG. 5, the apparatus includes a terminal board 41 accessible inside the outer cabinet. The terminal board 41 has three columns of terminals 1 to 12, there being one terminal in each column corresponding to the twelve cup-storage tubes 14. The columns of terminals are indicated W,X and Y. The terminals W are bridged together and are connected to an indicator lamp 42 to indicate that the cups containing the dry ingredients for a particular beverage are sold-out. Alternatively there may be a separate "Sold-Out" or "Empty" lamp connected to each of the terminals W. The or each lamp 42 is also connected to ground. Each terminal 1 to 12 of column X is connected to the N.C. terminal of the switch 38 associated with the respective cup-storage tube 14. The terminals 1 to 12 of column Y are each connected to the contact C of the corresponding switch 38. There are also several Product Selection Button Switches indicated A to H in column Z. There are the Product Selection Button Switches referred to hereinbefore in connection with FIG. 4. There may be the same number of button switches as cup-storage tubes but usually there would be more than one cup-storage tube for the cups containing the ingredients for a particular beverage, according to its popularity, and so several switches 38 may be connected in series as will be explained with reference to FIG. 6 and so a smaller number of button switches in column Z will be sufficient. Thus in this example only eight button switches have been illustrated.

To enable the modes of operation to be changed, readily removable fly-leads 43–46 connect certain of the button switches in column Z and certain of the terminals in columns W, X, Y. In this example, button switch A is connected to terminal Y-1, button switch B is connected to terminal Y-2, terminal X-1 is connected to terminal W-1 and terminal X-2 is connected to terminal W-2. Similar connections could be made between other terminals. It is assumed that the upper cup-storage tube 14-1 is empty of cups and the lower cup-storage tube 14-2 still has cups. On pressing button switch A a circuit is made from a supply conductor (not shown) through the fly-lead 43 to terminal Y-1, the contacts C and N.C. bridged by arm 39 in switch 38 of the upper cup-storage tube, terminal X-1 through fly-lead 44 to terminal W-1 and the lamp 42 will light indicating that the cups containing the product associated with button switch A is sold-out. The or another customer pressing button switch B will complete a circuit from the supply conductor of button B, the fly-lead 45, terminal Y-2, the bridge contacts C and N.O. of switch 38 and this will operate the motor 30 and cup-dispensing ring 13 associated with the relevant cup-storage tube 14-2, as described with reference to FIG. 4 and the appropriate beverage will be dispensed. When there are no cups in the cup-storage tube 14-2 associated with button switch B, and the button switch B is pressed, the circuit will be completed through fly-lead 46 to terminal W-2 and the product sold-out indicator lamp 42 will light, as described already for the cup-storage tube 14-1.

Referring now to FIG. 6, a different arrangement of the connections of the button switches of column Z and the terminals in columns W, X and Y are described to give a mode of operation suitable where there is a greater demand for one beverage compared with that for another product. For example, the demand for coffee with milk and sugar may be the greatest. In that case two or more of the cup-storage tubes would be filled with cups containing the dry ingredients for that beverage. Two such cup-storage tubes are 14-3 and 14-4. Button switch Z-C is connected by a fly-lead 47 to terminal Y-3. This is connected to the contact C of the switch 38 associated with cup-storage tube 14-3. The contact N.C. of that switch 38 is connected to terminal X-3, which is connected by fly-lead 48 to terminal Y-4. That terminal is connected to contact C of switch 38 associated with cup-storage tube 14-4. The contact N.C. of that switch 38 is connected to terminal X-4. That terminal is connected by fly-lead 49 to terminal W-4 and thus to the "Sold Out" or "Empty" lamp 42. Thus the switches 38 of the two cup-storage tubes 14-3 and 14-4 are connected in series with one switch button Z-C, as compared with the switches 14-1 and 14-2 which are connected individually to separate switch buttons Z-A and B. Further switches 38 associated with further cup-storage tubes 14 for receiving cups containing the same ingredients may also be connected in the series circuit. The mode of operation is such that on pressing button switch Z-C, cups will be dispensed from cup-storage tube 14-3 until there are no more cups in that tube. Then on the next operation of switch button Z-C, the arm 39 of the switch 38 associated with cup-storage tube 14-3 will fall to the position indicated in FIG. 6. The arm 39 thus bridges contacts C and N.C.; but instead of the lamp 42 lighting, the cup-dispensing ring of cup-storage tube 14-4 will be operated, that is assuming there are cups in that tube. Then on each further operation of the switch button Z-C a cup will be dispensed from cup-storage tube 14-4, until no more cups are left in that tube. Then, the next operation of the switch button Z-C will cause the lamp 42 to be illuminated, or, where the switch 38 of another cup-storage tube 14 is in the series circuit, a cup will be dispensed from that tube.

Some or each of the switch buttons Z may be individually connected as in FIG. 5 or some or all the switches 38 may be connected in series as in FIG. 6, according to the expected demand of a beverage or variety of different beverages to be provided.

When the lamp 42, or one of them where there are more than one, is illuminated to indicate that cups of a particular product have been sold out, the same completed circuit may be employed to operate a further switch to give a warning to a remote position, that that particular cup-storage tube, or tubes, requires re-filling. The warning to a remote position may be an automatic radio signal to a radio equipped service van or service station from which service vans operate.

A further refinement may be a second switch similar to 38 in each cup-storage tube 14 to indicate that there is only a predetermined number of cups left in that cup-storage tube, by way of an advance warning before the tube becomes empty. Alternatively or additionally, there may be detecting switches or scanning devices to detect how many cups are present in each cup-storage tube 14.

The outer portion of each cup-storage tube 14 may take the form of a pre-packed and sealed cartridge containing a stack of nested cups containing particular ingredients. The unit of cup-delivery tubes 11 and tubular branches 12 is withdrawn on the rails 16. A cap or wrapping at the lower end of a cartridge containing cups is removed and the cartridge is fitted on to the upper end of a tubular branch 12. In this way the filler of the machines does not touch any of the cups and thus by this arrangement the cups are not contaminated by handling.

Although the cup-dispensing mechanisms and circuits shown in FIGS. 4 to 6 have been described with particular reference to the apparatus shown in FIGS. 2 and 3, the same or similar mechanisms and circuits may be employed with the apparatus shown in FIG. 1.

Each time one of the motors 30 is operated to cause a cup to be released, another switch (not shown) is operated with an appropriate delay to open a valve for admitting water to the cup at the position 21 at the cup-loading station 20.

Besides the remote signal which may be given, for example to a radio equipped service van or service station, that a cup-storage tube is empty of cups, any other automatic remote signal as to the correct functioning or non-functioning of a part of the machine may be given to the service van or station.

What I claim as my invention and desire to secure by Letters Patent of the United States is:

1. Cup selection apparatus is a beverage vending machine, said cup selection apparatus comprising:

a plurality of cup-storage tubes in each of which, in use, there is placed a stack of cups nested one in another and containing dry ingredients to which water is to be added at a cup-filling station;

at least two substantially vertical cup-delivery tubes positioned side-by-side and each having at least two of said cup-storage tubes communicating therewith at positions spaced apart one above the other in the direction of the longitudinal axis of the cup-delivery tube, the cup-storage tubes extending from at least one side of the longitudinal axis of the respective cup-delivery tube, and each said cup-storage tube inclined at an acute angle to the longitudinal axis of said cup-delivery tube;

cup-guiding means leading from said cup-delivery tubes to said cup-filling station, and cup-dispensing means associated with each said cup-storage tube to separate the bottom cup from a stack of nested cups therein and to release said bottom cup to permit it to travel by gravity to the intersection of the cup-storage tube with the respective cup-delivery tube and through the latter and said cup-guiding means to said cup-filling station.

2. Cup selection apparatus as claimed in claim 1 in which the inclined cup-storage tubes communicating with a cup-delivery tube extend outwardly from one side only of the longitudinal axis of the cup-delivery tube.

3. Cup selection apparatus as claimed in claim 1 having two cup-delivery tubes arranged side-by-side with the respective cup-storage tubes extending outwardly from the side of the longitudinal axis of the associated cup-delivery tube remote from the other said cup-delivery tube.

4. Cup selection apparatus as claimed in claim 1 in which said cup-storage tubes extend outwardly from each said cup-delivery tube on diametrically-opposite sides of the longitudinal axis thereof.

5. Cup selection apparatus as claimed in claim 1 in which each said cup-delivery tube communicates, in use, at its lower end with a common chute, said chute constituting the aforesaid cup-guiding means.

6. Cup selection apparatus as claimed in claim 5 in which said chute tapers from an upper mouth shaped to receive cups from each said cup-delivery tube to an outlet through which cups will pass singly to the cup-filling station.

7. Cup selection apparatus for a beverage vending machine, said cup selection apparatus comprising:

a plurality of cup-storage tubes in each of which, in use, there is placed a stack of cups nested one in another and containing dry ingredients to which water is to be added at a cup-filling station;

at least one substantially vertical cup-delivery tube having at least two of said cup-storage tubes communicating therewith at positions spaced apart one above the other in the direction of the longitudinal axis of the cup-delivery tube, the cup-storage tubes extending from at least one side of the longitudinal axis of said cup-delivery tube, and each said cup-storage tube inclined at an acute angle to the longitudinal axis of said cup-delivery tube;

cup-guiding means leading from said cup-delivery tube to said cup-filling station, and cup-dispensing means associated with each said cup-storage tube to separate the bottom cup from a stack of nested cups therein and to release said bottom cup to permit it to travel by gravity to the intersection of the cup-storage tube with said cup-delivery tube and through the latter and said cup-guiding means to said cup-filling station, said cup-storage tubes and the associated cup-delivery tube being mounted, as a unit, for swinging about an axis relatively to said cup-filling station.

8. Cup selection apparatus in a beverage vending machine, said cup selection apparatus comprising:

a plurality of cup-storage tubes in each of which, in use, there is placed a stack of cups nested one in another and containing dry ingredients to which water is to be added at a cup-filling station;

at least one substantially vertical cup-delivery tube having at least two of said cup-storage tubes communicating therewith at positions spaced apart one above the other in the direction of the longitudinal axis of the cup-delivery tube, the cup-storage tubes extending from at least one side of the longitudinal axis of said cup-delivery tube, and each said cup-storage tube inclined at an acute angle to the longitudinal axis of said cup-delivery tube;

cup-guiding means leading from said cup-delivery tube to said cup-filling station, and cup-dispensing means associated with each said cup-storage tube to separate the bottom cup from a stack of nested cups therein and to release said bottom cup to permit it to travel by gravity to the intersection of the cup-storage tube with said cup-delivery tube and through the latter and said cup-guiding means to said cup-filling station, said cup-storage tubes and the associated cup-delivery tube being mounted, as a unit, for sliding transversely of the longitudinal axis of said cup-delivery tube relatively to said cup-filling station.

9. Cup selection apparatus in a beverage vending machine, said cup selection apparatus comprising;

a plurality of cup-storage tubes in each of which, in use, there is placed a stack of cups nested one in another and containing dry ingredients to which water is to be added at a cup-filling station;

at least one substantially vertical cup-delivery tube having at least two of said cup-storage tubes communicating therewith at positions spaced apart one above the other in the direction of the longitudinal axis of the cup-delivery tube, the cup-storage tubes extending from at least one side of the longitudinal axis of said cup-delivery tube, and each said cup-storage tube inclined at an acute angle to the longitudinal axis of said cup-delivery tube;

cup-guiding means leading from said cup-delivery tube to said cup-filling station, and cup-dispensing means associated with each said cup-storage tube to separate the bottom cup from a stack of nested cups therein and to release said bottom cup to permit it to travel by gravity to the intersection of the cup-storage tube with said cup-delivery tube and through the latter and said cup-guiding means to said cup-filling station, said cup-storage tubes and the associated cup-delivery tube being mounted, as a unit, for sliding parallel to the longitudinal axis of said cup-delivery tube relatively to said cup-filling station.

10. Cup selection apparatus in a beverage vending machine, said cup selection apparatus comprising:

a plurality of cup-storage tubes in each of which, in use, there is placed a stack of cups nested one in another and containing dry ingredients to which water is to be added at a cup-filling station;

at least two substantially vertical cup-delivery tubes positioned side-by-side and each having at least two of said cup-storage tubes communicating therewith at positions spaced apart one above the other in the direction of the longitudinal axis of the cup-delivery tube, the cup-storage tubes extending from at least one side of the longitudinal axis of the respective cup-delivery tube, and each said cup-storage tube inclined at an acute angle to the longitudinal axis of said cup-delivery tube;

cup-guiding means leading from said cup-delivery tubes to said cup-filling station, and cup-dispensing means associated with each said cup-storage tube to separate the bottom cup from a stack of nested cups therein and to release said bottom cup to permit it to travel by gravity to the intersection of the cup-storage tube with the respective cup-delivery tube and through the latter and said cup-guiding means to said cup-filling station, in which said cup-dispensing means is of the kind comprising a ring coaxial with said respective cup-storage tube and including jaw members which are movable into and out of positions in which they will engage the rim of a cup around its periphery and are operable to separate the bottom cup axially from the next higher cup in a stack of cups in said cup-storage tube and then to release the separated cup to permit it to travel downwardly to the associated cup-delivery tube, and electrically-operable means provided to operate said jaw members of said cup-dispensing means, said electrically-operable means being selectively-operable according to which beverage has been selected and therefore in which cup-storage tube a cup is to be separated from a stack of cups therein.

11. Cup selection apparatus as claimed in claim 10 in which for each said cup-dispensing ring there is a crank mechanism comprising a crank pin and a connecting rod, said connecting rod connected at one end thereof to said crank pin and at the other end thereof to said cup-dispensing ring and said electrically-operable means associated with said cup-dispensing ring is an electric motor operable to move said crank pin through a complete circular path each time a cup is to be released, whereby said jaw members are moved to separate a cup from the relevant stack of cups and to release said cup.

12. Cup selection apparatus as claimed in claim 11 in which a customer-operable selector switch is operable to energize a respective electric motor to turn a respective cup-dispensing ring to release a cup from a cup-storage tube according to the beverage selected.

13. Cup selection apparatus as claimed in claim 12 including detector means associated with each cup-storage tube and operative, where no cups remain in the respective cup-storage tube, to prevent activation of the respective electric motor for operating the respective cup-dispensing ring.

14. Cup selection apparatus as claimed in claim 13 in which the detector means includes a lever arranged to abut against the stack of cups in the respective cup-storage tube and to be held thereby in a first position and to fall, where there are no cups in the respective cup-storage tube, into a second position, a further switch operable by said lever to permit the respective electric motor to be operated by the appropriate customer selector switch when the lever is in said first position and said further switch being operative to prevent said activation of the respective electric motor when said lever is in said second position.

15. Cup selection apparatus as claimed in claim 14 in which said further switches of at least two cup-storage tubes are connected in series with a single customer-operable selector switch.

16. Cup selection apparatus as claimed in claim 14 including a terminal board and removable electrical connectors by which the electrical connections between said further switches of a plurality of cup-storage tubes and customer-operable selector switches are made.

17. Cup selection apparatus as claimed in claim 13 in which the detector means includes an indicator operable when a cup-storage tube is empty.

18. Cup selection apparatus as claimed in claim 17 including further cup-detecting means associated with each said cup-storage tube operable to indicate when the number of cups left in a respective cup-storage tube has reached a predetermined number greater than zero.

19. Cup selection apparatus as claimed in claim 17 in which said indicator includes a visual indicator in the vicinity of the apparatus and also activates a remote signal.

20. Cup selection apparatus in a beverage vending machine, said cup selection apparatus comprising:

a plurality of cup-storage tubes in each of which, in use, there is placed a stack of cups nested one in another and containing dry ingredients to which water is to be added at a cup-filling station;

at least two substantially vertical cup-delivery tubes positioned side-by-side and each having at least two of said cup-storage tubes communicating therewith at positions spaced apart one above the other in the direction of the longitudinal axis of the cup-delivery tube, the cup-storage tubes extending from at least one side of the longitudinal axis of the respective cup-delivery tube, and each said cup-storage tube inclined at an acute angle to the longitudinal axis of said cup-delivery tube;

cup-guiding means leading from said cup-delivery tubes to said cup-filling station, and cup-dispensing means associated with each said cup-storage tube to separate the bottom cup from a stack of nested cups therein and to release said bottom cup to permit it to travel by gravity to the intersection of the cup-storage tube with the respective cup-delivery tube and through the latter and said cup-guiding means to said cup-filling station, in which each said cup-storage tube has an upper part in which, before use, a removable cartridge containing a pre-packed stack of nested cups is insertable.

21. Cup selection apparatus for a beverage vending machine, said cup selection apparatus comprising:

a plurality of cup-storage tubes in each of which, in use, there is placed a stack of cups nested one in another and containing dry ingredients to which water is to be added at a cup-filling station;

at least one substantially vertical cup-delivery tube having at least two of said cup-storage tubes communicating therewith at positions spaced apart one above the other in the direction of the longitudinal axis of the cup-delivery tube, the cup-storage tubes extending from at least one side of the longitudinal axis of said cup-delivery tube, and each said cup-storage tube inclined at an acute angle to the longitudinal axis of said cup-delivery tube;

cup-guiding means leading from said cup-delivery tube to said cup-filling station, and selectively-operable cup-dispensing means associated with each said cup-storage tube to separate the bottom cup from a stack of nested cups therein and to release said bottom cup to permit it to travel by gravity to the intersection of the cup-storage tube with said cup-delivery tube and through the latter and said cup-guiding means to said cup-filling station.

22. Cup selection apparatus for a beverage vending machine, said cup selection apparatus comprising:

a plurality of cup-storage tubes in each of which, in use, there is placed a stack of cups nested one in another and containing dry ingredients to which water is to be added at a cup-filling station;

at least one substantially vertical cup-delivery tube having at least two of said cup-storage tubes communicating therewith at positions spaced apart one above the other in the direction of the longitudinal axis of the cup-delivery tube, the cup-storage tubes extending from at least one side of the longitudinal axis of said cup-delivery tube, and each said cup-storage tube inclined at an acute angle to the longitudinal axis of said cup-delivery tube;

cup-guiding means leading from said cup-delivery tube to said cup-filling station, and cup-dispensing means associated with each said cup-storage tube to separate the bottom cup from a stack of nested cups therein and to release said bottom cup to permit it to travel by gravity to the intersection of the cup-storage tube with said cup-delivery tube and through the latter and said cup-guiding means to said cup-filling station, in which said cup-dispensing means is of the kind comprising a ring coaxial with said respective cup-storage tube and including jaw members which are movable into and out of positions in which they will engage the rim of a cup around its periphery and are operable to separate the bottom cup axially from the next higher cup in a stack of cups in said cup-storage tube and then to release the separated cup to permit it to travel downwardly to the associated cup-delivery tube, and electrically-operable means provided to operate said jaw-members of said cup-dispensing means, said electrically-operable means being selectively-operable according to which beverage has been selected and therefore in which cup-storage tube a cup is to be separated from a stack of cups therein, said cup-selection apparatus also including detector means associated with each said cup-storage tube and operative, where no cups remain in the respective cup-storage tube to prevent activation of the respective electrically-operable means, said detector means comprising a first indicator operable when said respective cup-storage tube is empty of cups and a second indicator operable when the number of cups remaining in said respective cup-storage tube has fallen to a predetermined number greater than zero.

* * * * *